US010729618B2

(12) United States Patent
Yaegashi

(10) Patent No.: US 10,729,618 B2
(45) Date of Patent: Aug. 4, 2020

(54) LIQUID MEDICINE FILLING DEVICE AND LIQUID MEDICINE FILLING METHOD

(71) Applicant: TERUMO KABUSHIKI KAISHA, Tokyo (JP)

(72) Inventor: Mitsutoshi Yaegashi, Nagashima (JP)

(73) Assignee: TERUMO KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/359,595

(22) Filed: Mar. 20, 2019

(65) Prior Publication Data

US 2019/0216683 A1 Jul. 18, 2019

Related U.S. Application Data

(63) Continuation of application No. PCT/JP2017/031944, filed on Sep. 5, 2017.

(30) Foreign Application Priority Data

Sep. 26, 2016 (JP) ..... 2016-186622

(51) Int. Cl.
*A61J 1/20* (2006.01)

(52) U.S. Cl.
CPC ..... *A61J 1/2072* (2015.05); *A61J 1/20* (2013.01); *A61J 1/201* (2015.05); *A61J 1/2037* (2015.05);
(Continued)

(58) Field of Classification Search
CPC ..... A61J 1/05; A61J 1/14; A61J 1/20; A61J 1/2072; A61J 1/2048; A61J 1/2096; A61J 1/201; A61J 1/2037; A61J 2200/76
See application file for complete search history.

(56) References Cited

U.S. PATENT DOCUMENTS 7,794,434 B2 * 9/2010 Mounce ..... A61J 1/1406 604/131
7,828,764 B2 * 11/2010 Moberg ..... A61J 1/1406 604/155
(Continued)

FOREIGN PATENT DOCUMENTS

EP 2 258 333 A1 12/2010
JP S55-156748 U 11/1980
(Continued)

OTHER PUBLICATIONS

International Searching Authority, Written Opinion issues in connection with International Patent Application No. PCT/JP2017/031944, dated Nov. 21, 2017.
(Continued)

*Primary Examiner* — Nicolas A Arnett
(74) *Attorney, Agent, or Firm* — Foley & Lardner LLP

(57) ABSTRACT

A liquid medicine filling device includes a container mounting unit, a liquid delivery flow conduit, a ventilation flow conduit, a syringe, a connection flow conduit, a first flow path switching unit, and a second flow path switching unit. The first flow path switching unit may switch between a flow path for filling through which the syringe communicates with a liquid medicine container via the ventilation flow conduit and a flow path for air removal through which the syringe communicates with the connection flow conduit via the ventilation flow conduit. The second flow path switching unit may switch between a flow path for filling through which the liquid medicine container communicates with the liquid medicine storage unit via the liquid delivery flow conduit and a flow path for air removal through which the liquid medicine storage unit communicates with the connection flow conduit via the liquid delivery flow conduit.

20 Claims, 10 Drawing Sheets

(52) U.S. Cl.
CPC ..... *A61J 1/2048* (2015.05); *A61J 1/2096* (2013.01); *A61J 2200/76* (2013.01)

(56) References Cited

U.S. PATENT DOCUMENTS

| | | | | |
|---|---|---|---|---|
| 7,938,801 | B2 * | 5/2011 | Hawkins | A61M 5/14248 604/131 |
| 7,976,505 | B2 * | 7/2011 | Hines | A61M 5/14212 141/323 |
| 8,287,495 | B2 * | 10/2012 | Michaud | F04B 53/143 604/151 |
| 8,602,067 | B2 * | 12/2013 | Kuhni | A61J 1/20 141/114 |
| 8,905,972 | B2 * | 12/2014 | Smith | A61M 5/14248 604/152 |
| 9,352,865 | B2 * | 5/2016 | Kuehni | A61J 1/20 |
| 9,611,058 | B2 * | 4/2017 | Mueller | A61J 1/2089 |
| 10,363,367 | B2 * | 7/2019 | Mueller-Pathle | A61M 5/2033 |
| 2008/0051765 | A1 * | 2/2008 | Mounce | A61J 1/1406 604/890.1 |
| 2008/0097327 | A1 * | 4/2008 | Bente | A61J 1/1406 604/155 |
| 2009/0318893 | A1 * | 12/2009 | English | A61J 1/2089 604/520 |
| 2011/0108158 | A1 | 5/2011 | Huwiler et al. | |

FOREIGN PATENT DOCUMENTS

| | | |
|---|---|---|
| JP | 2000-316970 A | 11/2000 |
| JP | 2016-064014 A | 4/2016 |

OTHER PUBLICATIONS

International Searching Authority, "International Search Report," issues in connection with International Patent Application No. PCT/JP2017/031944, dated Nov. 21, 2017.

* cited by examiner

LIQUID MEDICINE FILLING DEVICE AND LIQUID MEDICINE FILLING METHOD

CROSS-REFERENCE TO RELATED APPLICATIONS

This is a bypass continuation of PCT Application No. PCT/JP2017/031944, filed on Sep. 5, 2017, which claims priority to Japanese Application No. 2016-186622, filed on Sep. 26, 2016. The contents of these applications are hereby incorporated by reference in their entireties.

BACKGROUND

The present disclosure relates to a liquid medicine filling device and a liquid medicine filling method for filling a liquid medicine administration device including a liquid medicine storage unit with a liquid medicine.

In recent years, a treatment method for continually administering a liquid medicine to a patient's body by subcutaneous injection, intravenous injection, or the like has been performed. For example, as a treatment method for diabetes patients, a treatment for continually injecting a low amount of insulin into the patient's body is performed. In this treatment method, a portable liquid medicine administration device (e.g., a so-called insulin pump), which may be fixed to the patient's body or clothes to be carried, is used to administer a liquid medicine (e.g., insulin) to the patient throughout the day.

When the liquid medicine administration device is provided to a user, a liquid medicine storage unit in which the liquid medicine is stored is not filled with the liquid medicine in advance. Therefore, when using the liquid medicine administration device, the user needs to perform an operation to fill the liquid medicine storage unit of the liquid medicine administration device with the liquid medicine from a liquid medicine container (for example, a vial) in which the liquid medicine is separately stored.

Also, in order to reduce a thickness of the liquid medicine administration device, it is proposed to form the liquid medicine storage unit of a flexible film. EP Patent No. 2258333 discloses a technology for filling such a liquid medicine storage unit with liquid medicine. In EP Patent No. 2258333, the liquid medicine storage unit is filled with the liquid medicine by using two syringes and a plurality of valves, and then, air in the liquid medicine storage unit is removed.

SUMMARY

However, because two syringes are provided for filling the liquid medicine and removing the air in the technology disclosed in EP Patent No. 2258333, there is a problem that the entire device must be large due to the two syringes.

In consideration of the above problems, an object of certain embodiments of the present disclosure is to provide a liquid medicine filling device and a liquid medicine filling method capable of reducing the size of the device.

According to one embodiment, a liquid medicine filling device is provided for filling a liquid medicine storage unit of a liquid medicine administration device with a liquid medicine. The liquid medicine filling device includes a liquid delivery flow conduit, a ventilation flow conduit, a syringe, a connection flow conduit, a first flow path switching unit, and a second flow path switching unit. The liquid delivery flow conduit is connected to a liquid medicine container accommodating the liquid medicine, and is connected to a filling port of the liquid medicine storage unit. The ventilation flow conduit is connected to the liquid medicine container. The syringe is connected to the ventilation flow conduit and discharges air to the ventilation flow conduit or draws the air from the ventilation flow conduit. The connection flow conduit connects the ventilation flow conduit and the liquid delivery flow conduit. The first flow path switching unit is provided in a connection portion between the ventilation flow conduit and the connection flow conduit. The first flow path switching unit may switch between a flow path for filling through which the syringe communicates with the liquid medicine container via the ventilation flow conduit and a flow path for air removal through which the syringe communicates with the connection flow conduit via the ventilation flow conduit. The second flow path switching unit is provided in a connection portion between the liquid delivery flow conduit and the connection flow conduit. The second flow path switching unit may switch between a flow path for filling through which the liquid medicine container communicates with the liquid medicine storage unit via the liquid delivery flow conduit and a flow path for air removal through which the liquid medicine storage unit communicates with the connection flow conduit via the liquid delivery flow conduit.

According to another embodiment, a liquid medicine filling device is provided for filling a liquid medicine storage unit of a liquid medicine administration device with a liquid medicine. The liquid medicine filling device includes a liquid delivery flow conduit, a ventilation flow conduit, a syringe, a connection flow conduit, a flow path switching unit, a first check valve, and a second check valve. The liquid delivery flow conduit is connected to a liquid medicine container accommodating the liquid medicine and is connected to a filling port of the liquid medicine storage unit. The ventilation flow conduit is connected to the liquid medicine container. The syringe is connected to the ventilation flow conduit and discharges air to the ventilation flow conduit or draws the air in the ventilation flow conduit. The connection flow conduit connects the ventilation flow conduit and the liquid delivery flow conduit. The flow path switching unit is provided in a connection portion between the liquid delivery flow conduit and the connection flow conduit. The flow path switching unit may switch between a flow path for filling through which the liquid medicine container communicates with the liquid medicine storage unit via the liquid delivery flow conduit and a flow path for air removal through which the liquid medicine storage unit communicates with the connection flow conduit via the liquid delivery flow conduit. The first check valve is provided on a side closer to the liquid medicine container than the connection portion to the connection flow conduit on the ventilation flow conduit. The second check valve is provided on the connection flow conduit. The first check valve regulates a flow of air and the liquid medicine from the liquid medicine container to the connection flow conduit and the syringe in the ventilation flow conduit. The second check valve regulates a flow of the air from the ventilation flow conduit to the liquid delivery flow conduit in the connection flow conduit.

According to another embodiment, a liquid medicine filling method is provided for mounting a liquid medicine administration device on a liquid medicine filling device provided with a liquid delivery flow conduit connected to a filling port of the liquid medicine administration device to which a liquid medicine container accommodating a liquid medicine is connected, and a ventilation flow conduit connected to the liquid medicine container, and filling a liquid medicine storage unit of the liquid medicine administration device with the liquid medicine. The method includes: (1) a first flow path switching step of operating a first flow path switching unit provided in a connection portion between a connection flow conduit connecting the ventilation flow conduit and the liquid delivery flow conduit and the ventilation flow conduit to allow a syringe of the liquid medicine filling device to communicate with the liquid medicine container via the ventilation flow conduit and close a flow path from the ventilation flow conduit to the connection flow conduit, and of operating a second flow path switching unit provided in a connection portion between the liquid delivery flow conduit and the connection flow conduit to allow the liquid medicine container to communicate with the liquid medicine storage unit via the liquid delivery flow conduit and close a flow path from the liquid delivery flow conduit to the connection flow conduit; (2) a step of operating the syringe to fill the liquid medicine storage unit with the liquid medicine accommodated in the liquid medicine container; (3) a second flow path switching step of operating the first flow path switching unit to allow the syringe to communicate with the connection flow conduit via the ventilation flow conduit and close a flow path from the syringe to the liquid medicine container and operating the second flow path switching unit to allow the liquid medicine storage unit to communicate with the connection flow conduit via the liquid delivery flow conduit and close a flow path from the liquid medicine container to the liquid medicine storage unit; and (4) a step of operating the syringe to discharge residual air remaining in the liquid medicine container.

The first flow path switching step may be performed before and after mounting the liquid medicine administration device on the liquid medicine filling device.

According to another embodiment a liquid medicine filling method is provided for mounting a liquid medicine administration device on a liquid medicine filling device provided with a liquid delivery flow conduit connected to a filling port of the liquid medicine administration device to which a liquid medicine container accommodating the liquid medicine is connected, and a ventilation flow conduit connected to the liquid medicine container, and filling a liquid medicine storage unit of the liquid medicine administration device with the liquid medicine. The method includes: (1) a first flow path switching step of operating a flow path switching unit provided in a connection portion between a connection flow conduit connecting the liquid delivery flow conduit and the ventilation flow conduit and the liquid delivery flow conduit to allow the liquid medicine container to communicate with the liquid medicine storage unit via the liquid delivery flow conduit; (2) a step of operating a syringe of the liquid medicine filling device to fill the liquid medicine storage unit with the liquid medicine accommodated in the liquid medicine container; (3) a second flow path switching step of operating the flow path switching unit to allow the liquid medicine storage unit to communicate with the connection flow conduit via the liquid delivery flow conduit; and (4) a step of operating the syringe to discharge residual air remaining in the liquid medicine container. In the liquid medicine filling method, a first check valve provided on a side closer to the liquid medicine container than a connection portion to the connection flow conduit on the ventilation flow conduit regulates a flow of air and the liquid medicine from the liquid medicine container to the connection flow conduit and the syringe in the ventilation flow conduit. Also, a second check valve provided on the connection flow conduit regulates a flow of the air from the ventilation flow conduit to the liquid delivery flow conduit in the connection flow conduit.

The first flow path switching step may be performed before and after mounting the liquid medicine administration device on the liquid medicine filling device.

According to the liquid medicine filling device and the liquid medicine filling method, it is possible to fill the liquid medicine and remove the air with one syringe, and it is possible to reduce the size of the device.

BRIEF DESCRIPTION OF THE DRAWINGS

FIGS. 5A and 5B illustrate an interlocking mechanism, in which FIG. 5A is a plan view, and FIG. 5B is a cross-sectional view taken along line A-A of FIG. 5A.

FIGS. 7A and 7B illustrate a schematic configuration of a liquid medicine filling device according to a third embodiment, in which FIG. 7A is a view illustrating a state when setting a pusher position at the time of filling, and FIG. 7B is a view illustrating a liquid medicine filling operation.

FIGS. 8A and 8B illustrate a schematic configuration of a liquid medicine filling device according to the third embodiment, in which FIG. 8A is a view illustrating a state when setting a pusher position at the time of air removal, and FIG. 8B is a view illustrating an air removing operation.

FIGS. 9A and 9B illustrate a schematic configuration of a liquid medicine filling device according to a fourth embodiment, in which FIG. 9A is a view illustrating a liquid medicine filling operation, and FIG. 9B is a view illustrating an air removing operation.

FIGS. 10A and 10B illustrate a schematic configuration of a liquid medicine filling device according to a fifth embodiment, in which FIG. 10A is a view illustrating a liquid medicine filling operation, and FIG. 10B is a view illustrating an air removing operation.

DETAILED DESCRIPTION

Embodiments of a liquid medicine filling device and a liquid medicine filling method according to the present invention are hereinafter described with reference to FIGS. 1 to 10B. Note that, members common throughout the drawings are assigned with the same reference signs. The present invention is not limited to the following embodiments.

1. First Embodiment 1-1. Configuration of Liquid Medicine Filling Device

First, a configuration example of a liquid medicine filling device according to a first embodiment (hereinafter referred to as "this embodiment") is described with reference to FIGS. 1 and 2.

Figure 1:
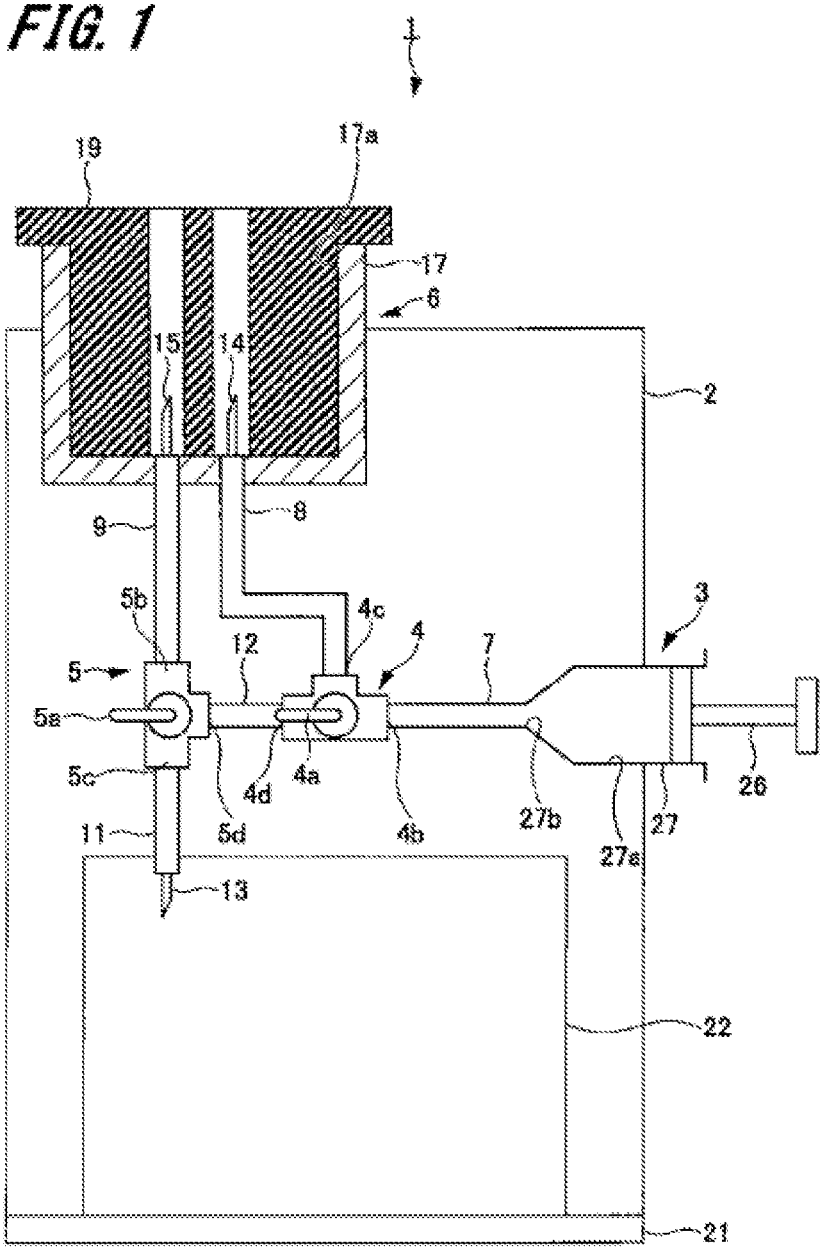
FIG. 1 is a front view illustrating a schematic configuration of a liquid medicine filling device according to a first embodiment.
Figure 2:
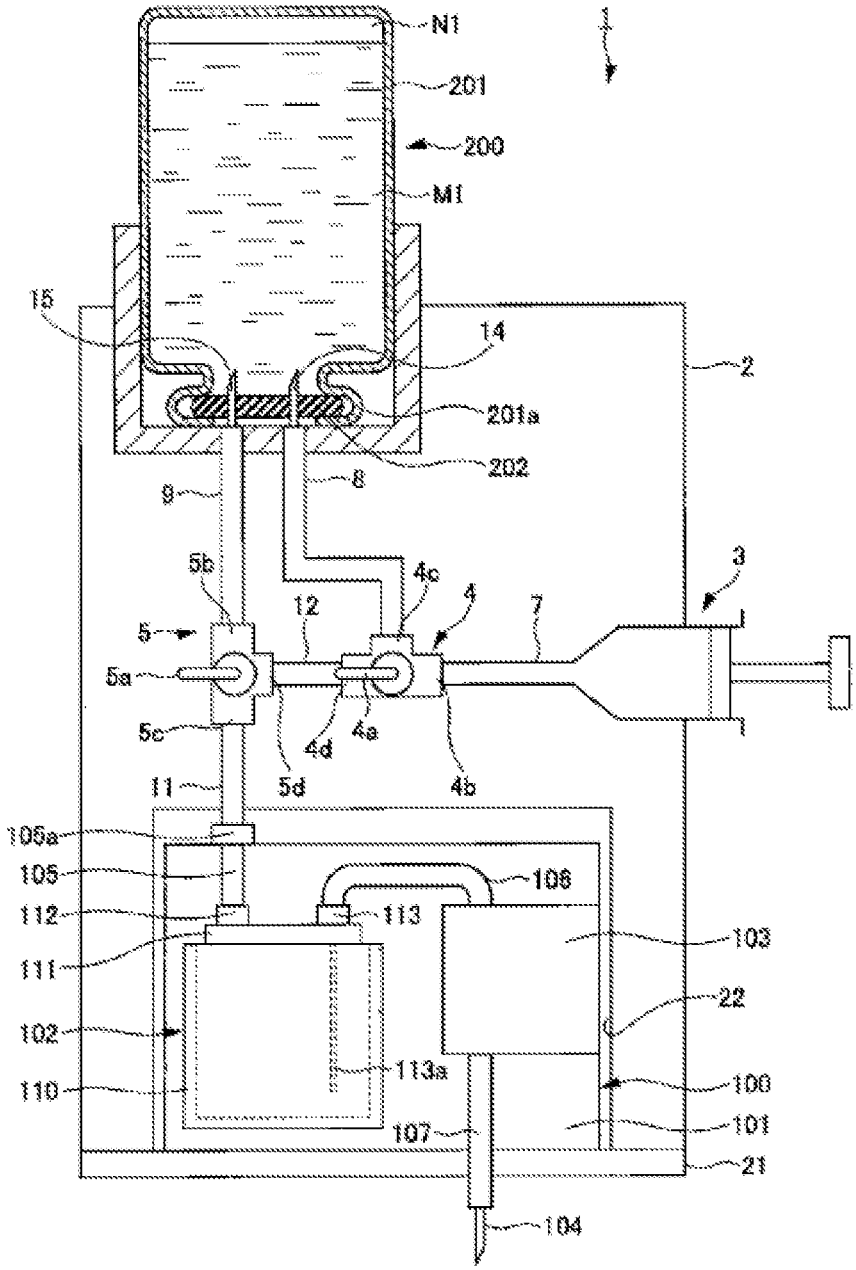
FIG. 2 is a front view illustrating a state in which a liquid medicine administration device is mounted on the liquid medicine filling device according to the first embodiment.

FIG. 1 is a front view illustrating a schematic configuration of the liquid medicine filling device, and FIG. 2 is a view illustrating a state in which a liquid medicine administration device is mounted on the liquid medicine filling device.

[Liquid Medicine Filling Device]

A device illustrated in FIG. 1 is a device which fills a liquid medicine storage unit of a portable insulin pump for continually administer a liquid medicine into a patient's body with liquid medicine such as a patch type or a tube type insulin pump and other portable liquid medicine filling devices.

As illustrated in FIGS. 1 and 2, a liquid medicine filling device 1 is provided with a housing 2, a syringe 3, a first three-way stopcock 4, a second three-way stopcock 5, and a container mounting unit 6. Also, the liquid medicine filling device 1 includes a first ventilation flow conduit 7, a second ventilation flow conduit 8, a first liquid delivery flow conduit 9, a second liquid delivery flow conduit 11, a connection flow conduit 12, and a connection needle tube 13.

The housing 2 is formed into a substantially rectangular parallelepiped shape. The housing 2 includes a pedestal portion 21 and a mounting unit 22. The pedestal portion 21 is provided on one end in a longitudinal direction of the housing 2. The liquid medicine filling device 1 is erected such that the longitudinal direction of the housing 2 is substantially parallel to a vertical direction by placing the pedestal portion 21 on a desk or a table. The mounting unit 22 is formed in the vicinity of the pedestal portion 21 in the housing 2.

The mounting unit 22 is obtained by opening the housing 2 in a substantially rectangular shape. A liquid medicine administration device 100 (refer to FIG. 2) to be described later is detachably mounted on the mounting unit 22.

Also, the housing 2 is provided with the syringe 3, the first three-way stopcock 4, the second three-way stopcock 5, the container mounting unit 6, and a plurality of flow paths 7, 8, 9, 11, and 12 through which a liquid medicine M1 and air pass.

The syringe 3 is arranged above the mounting unit 22 formed on the housing 2 in the vertical direction. The syringe 3 includes a main body portion 27 and a pusher 26. The main body portion 27 is formed into a cylindrical shape with one end in an axial direction closed and the other end in the axial direction opened. Also, one end in the axial direction of the main body portion 27, that is, a tip end 27*b* communicates with the first ventilation flow conduit 7.

The pusher 26 is slidably inserted into a cylindrical hole 27*a* of the main body portion 27. The pusher 26 is in close contact with an inner wall of the cylindrical hole 27*a*. When the pusher 26 is pushed toward the tip end 27*b* of the main body portion 27, the air in the cylindrical hole 27*a* of the main body portion 27 is discharged from the tip end 27*b* to the first ventilation flow conduit 7. Also, when the pusher 26 arranged on the tip end 27*b* is pulled toward the other end of the main body portion 27, the air in the first ventilation flow conduit 7 is drawn from the tip end 27*b* of the main body portion 27 into the cylindrical hole 27*a*.

An end on a side opposite to the syringe 3 of the first ventilation flow conduit 7 is connected to the first three-way stopcock 4. The first three-way stopcock 4 being an example of a first flow path switching unit includes a switching lever 4*a*, a first flow path port 4*b*, a second flow path port 4*c*, and a third flow path port 4*d*.

The first ventilation flow conduit 7 is connected to the first flow path port 4*b*. The second ventilation flow conduit 8 is connected to the second flow path port 4*c*. Also, the connection flow conduit 12 is connected to the third flow path port 4*d*. By operating the switching lever 4*a*, one of the first flow path port 4*b*, the second flow path port 4*c*, and the third flow path port 4*d* is closed and the remaining two flow path ports may be communicated with each other.

The first three-way stopcock 4 is configured to switch a flow path through which the air flows at least between a flow path for filling through which the syringe 3 communicates with a vial 200 via the first ventilation flow conduit 7 and the second ventilation flow conduit 8, and a flow path for air removal through which the syringe 3 communicates with the connection flow conduit 12 via the first ventilation flow conduit 7.

An end on a side opposite to the first three-way stopcock 4 of the second ventilation flow conduit 8 is connected to a ventilation needle tube 14 of the container mounting unit 6 to be described later. Also, the air passes through the first ventilation flow conduit 7 and the second ventilation flow conduit 8.

The container mounting unit 6 is arranged on an upper end in the vertical direction of the housing 2. The vial 200 being an example of a liquid medicine container is mounted on the container mounting unit 6. The vial 200 includes a container 201 for accommodating the liquid medicine M1 and a lid 202. The lid 202 is formed of, for example, a rubber stopper. The lid 202 seals an opening of an opening 201*a* of the container 201.

The container mounting unit 6 includes a supporting unit 17, the ventilation needle tube 14, and a liquid delivery needle tube 15. The supporting unit 17 is formed into a substantially cylindrical shape with one end in an axial direction closed and the other end in the axial direction opened. The opening of the supporting unit 17 is set to have a size through which the container 201 and the opening 201*a* of the vial 200 may be inserted.

Also, the ventilation needle tube 14 and the liquid delivery needle tube 15 protrude into the cylindrical hole 17*a* at one end in the axial direction of the supporting unit 17. The ventilation needle tube 14 is connected to the second ventilation flow conduit 8. The liquid delivery needle tube 15 is connected to the first liquid delivery flow conduit 9.

Also, as illustrated in FIG. 1, in a state before mounting the vial 200 on the supporting unit 17, a stopper member 19 is inserted into the cylindrical hole 17*a* of the supporting unit 17. As a result, it is possible to prevent accidental puncture of a user by the ventilation needle tube 14 and the liquid delivery needle tube 15.

Also, as illustrated in FIG. 2, the opening 201*a* of the vial 200 is inserted into the cylindrical hole 17*a* of the supporting unit 17. The cylindrical hole 17*a* of the supporting unit 17 is fitted with the container 201 and the opening 201*a*. As a result, the vial 200 is supported by the supporting unit 17 in a state in which the opening 201*a* faces downward in the vertical direction.

Also, when the opening 201*a* of the vial 200 is inserted into the cylindrical hole 17*a*, the ventilation needle tube 14 and the liquid delivery needle tube 15 pierce the lid 202 and penetrates the lid 202. As a result, the second ventilation flow conduit 8 communicates with the inside of the container 201 via the ventilation needle tube 14, and the first liquid delivery flow conduit 9 communicates with the inside of the container 201 via the liquid delivery needle tube 15.

An end on a side opposite to the liquid delivery needle tube 15 of the first liquid delivery flow conduit 9 is connected to the second three-way stopcock 5. The second three-way stopcock 5 being an example of a second flow path switching unit includes a switching lever 5*a*, a first flow path port 5*b*, a second flow path port 5*c*, and a third flow path port 5*d*.

The first liquid delivery flow conduit 9 is connected to the first flow path port 5*b*. The second liquid delivery flow conduit 11 is connected to the second flow path port 5*c*. Also, the connection flow conduit 12 is connected to the third flow path port 5*d*. By operating the switching lever 5*a*, one of the first flow path port 5*b*, the second flow path port 5*c*, and the third flow path port 5*d* is closed and the remaining two flow path ports are communicated with each other. Also, by orienting the switching lever 5*a* to a side opposite to the third flow path port 5*d*, all of the first flow path port 5*b*, the second flow path port 5*c*, and the third flow path port 5*d* are communicated with one another.

The second three-way stopcock 5 is configured to be able to switch a flow path through which the liquid medicine M1 and the air pass at least between a flow path for filling through which the vial 200 communicates with a liquid medicine storage unit 102 to be described later via the first liquid delivery flow conduit 9 and the second liquid delivery flow conduit 11 and a flow path for air removal through which the liquid medicine storage unit 102 communicates with the connection flow conduit 12 via the second liquid delivery flow conduit 11.

The connection needle tube 13 is connected to an end on a side opposite to the second three-way stopcock 5 of the second liquid delivery flow conduit 11. Also, the connection needle tube 13 protrudes from an upper end in the vertical direction of the mounting unit 22 into the mounting unit 22. The connection needle tube 13 pierces a rubber stopper 105*a* of a filling port 105 of the liquid medicine administration device 100 to be described later and communicates with the liquid medicine storage unit 102 of the liquid medicine administration device 100.

Also, the liquid medicine M1 or the air passes through the first liquid delivery flow conduit 9 and the second liquid delivery flow conduit 11.

One end of the connection flow conduit 12 is connected to the first three-way stopcock 4 and the other end of the connection flow conduit 12 is connected to the second three-way stopcock 5. That is, the connection flow conduit 12 is connected to the first ventilation flow conduit 7 and the second ventilation flow conduit 8 via the first three-way stopcock 4 and is connected to the first liquid delivery flow conduit 9 and the second liquid delivery flow conduit 11 via the second three-way stopcock 5. The air passes through the connection flow conduit 12.

[Liquid Medicine Administration Device]

Next, a configuration of the liquid medicine administration device 100 to be filled with the liquid medicine by using the liquid medicine filling device 1 described above is described.

As illustrated in FIG. 2, the liquid medicine administration device 100 includes a case 101, the liquid medicine storage unit 102, a pump unit 103, a puncture needle 104, the filling port 105, a first liquid delivery tube 106, and a second liquid delivery tube 107.

The case 101 is formed into a flat plate shape having a substantially rectangular shape. In this case 101, the liquid medicine storage unit 102, the pump unit 103, the filling port 105, the first liquid delivery tube 106, and the second liquid delivery tube 107 are accommodated.

The liquid medicine storage unit 102 includes a bag unit 110 and a cap member 111. The liquid medicine is stored in the bag unit 110. The bag unit 110 is formed of a flexible film member such as a polyethylene film, for example.

The cap member 111 is formed of a material harder than that of the bag unit 110. The cap member 111 includes a filling opening 112 through which the liquid medicine is filled and a liquid delivery port 113 through which the liquid medicine stored in the bag unit 110 is delivered. The filling port 105 is connected to the filling opening 112. The first liquid delivery tube 106 is connected to the liquid delivery port 113.

Also, a suction pipe 113*a* inserted into the bag unit 110 is connected to the liquid delivery port 113. The suction pipe 113*a* extends to the vicinity of an end on a side opposite to the cap member 111 in the bag unit 110. Then, the liquid medicine stored in the bag unit 110 is drawn from the suction pipe 113*a* to be delivered from the liquid delivery port 113. By inserting the suction pipe 113*a* into the bag unit 110, an amount of the liquid medicine remaining in the bag unit 110 may be reduced and further the bag unit 110 may be flattened when delivering the liquid medicine.

The liquid medicine storage unit 102 is formed, for example, as follows. First, the cap member 111 is fixed to the bag unit 110 formed into the film shape, for example, by ultrasonic welding. Next, the bag unit 110 is folded, and three sides other than one side to which the cap member 111 is attached are fixed by heat welding, high-frequency welding, ultrasonic welding, bonding with an adhesive, bonding with a solvent or the like. Next, the suction pipe 113*a* is inserted into the bag unit 110 from the liquid delivery port 113 of the cap member 111. As a result, the liquid medicine storage unit 102 is formed.

Also, the liquid medicine storage unit 102 is not limited to a bag-shaped unit formed of the flexible film member described above. For example, a liquid medicine storage unit having a shape contractable and expandable according to a change in inner volume may be used, or a bellows-like liquid medicine storage unit having valleys alternately formed may be used as the liquid medicine storage unit. Furthermore, a syringe-shaped liquid medicine storage unit formed into a cylindrical shape provided with a plunger sliding therein which discharges the liquid medicine accommodated in the liquid medicine storage unit by the plunger may also be used. For example, a resin material such as a cyclic olefin polymer, polypropylene, and polyethylene terephthalate is used to be formed by injection molding and the like as such liquid medicine storage unit.

The pump unit 103 is connected to the liquid medicine storage unit 102 via the first liquid delivery tube 106. The second liquid delivery tube 107 is connected to the pump unit 103. The puncture needle 104 is connected to an end on a side opposite to the pump unit 103 of the second liquid delivery tube 107.

The pump unit 103 is, for example, a piezoelectric pump including a liquid contacting unit in contact with the liquid medicine and a driving unit formed of a piezoelectric element. As the pump unit 103, for example, SDMP 302C distributed by Takasago Electric, Inc. is used. As the driving unit is driven, the pump unit 103 draws the liquid medicine stored in the liquid medicine storage unit 102 and delivers the liquid medicine toward the puncture needle 104 via the second liquid delivery tube 107. Note that, the pump unit 103 is not limited to the piezoelectric pump, and various types of pumps such as a diaphragm pump, a rotary pump and the like may be applied.

The puncture needle 104 is formed of a hollow needle which may pierce the skin of the user. The puncture needle 104 may be a metal needle having high rigidity or a cannula having flexibility. From the puncture needle 104, the liquid medicine stored in the liquid medicine storage unit 102 is administered to the user via the pump unit 103.

The filling port 105 is connected to the filling opening 112 of the liquid medicine storage unit 102. The rubber stopper 105*a* is provided on an end on a side opposite to the filling opening 112 of the filling port 105. The connection needle tube 13 of the liquid medicine filling device 1 to be described later pierces the rubber stopper 105*a*. As a result, the filling port 105 communicates with the liquid medicine filling device 1.

1-2. Liquid Medicine Filling Operation of Liquid Medicine Filling Device

Next, an example of a liquid medicine filling operation step of the liquid medicine filling device 1 having the above-described configuration is described with reference to FIGS. 2 to 4.

Figure 3:
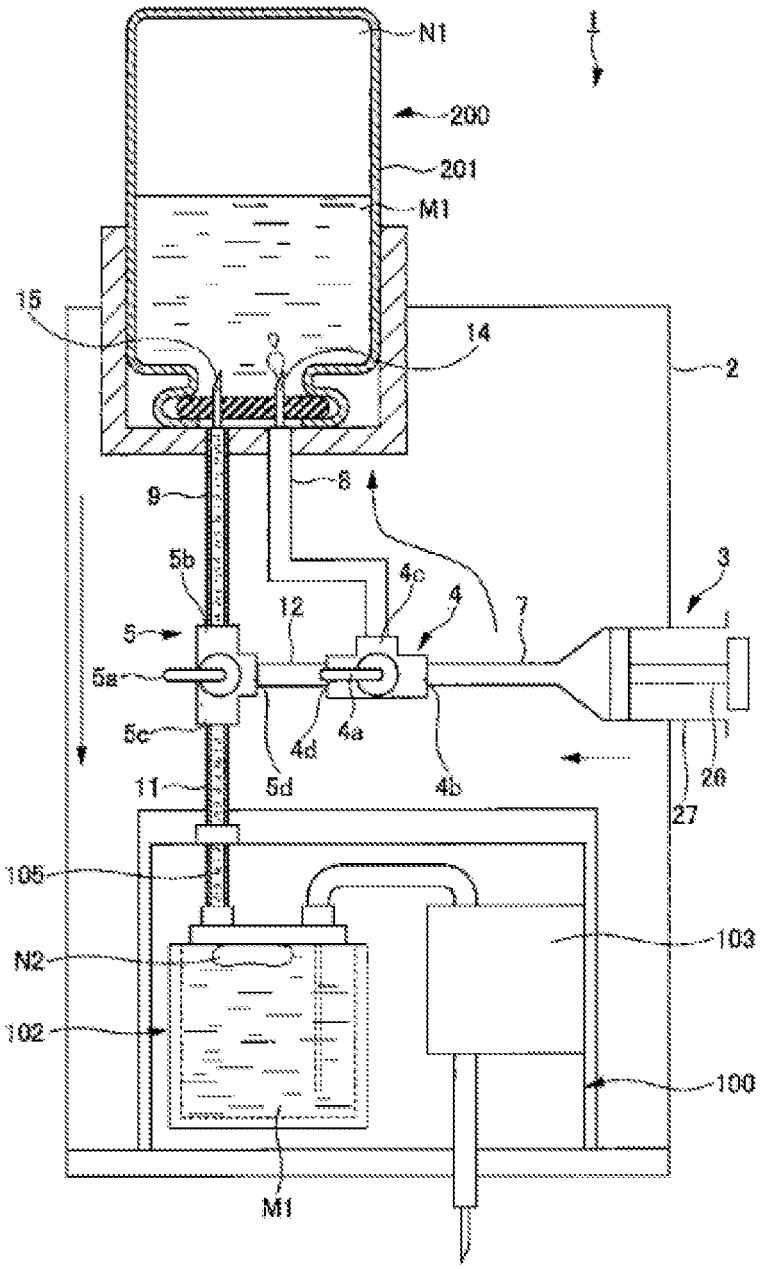
FIG. 3 is a front view illustrating a state in which a liquid medicine filling operation is performed by the liquid medicine filling device according to the first embodiment.
Figure 4:
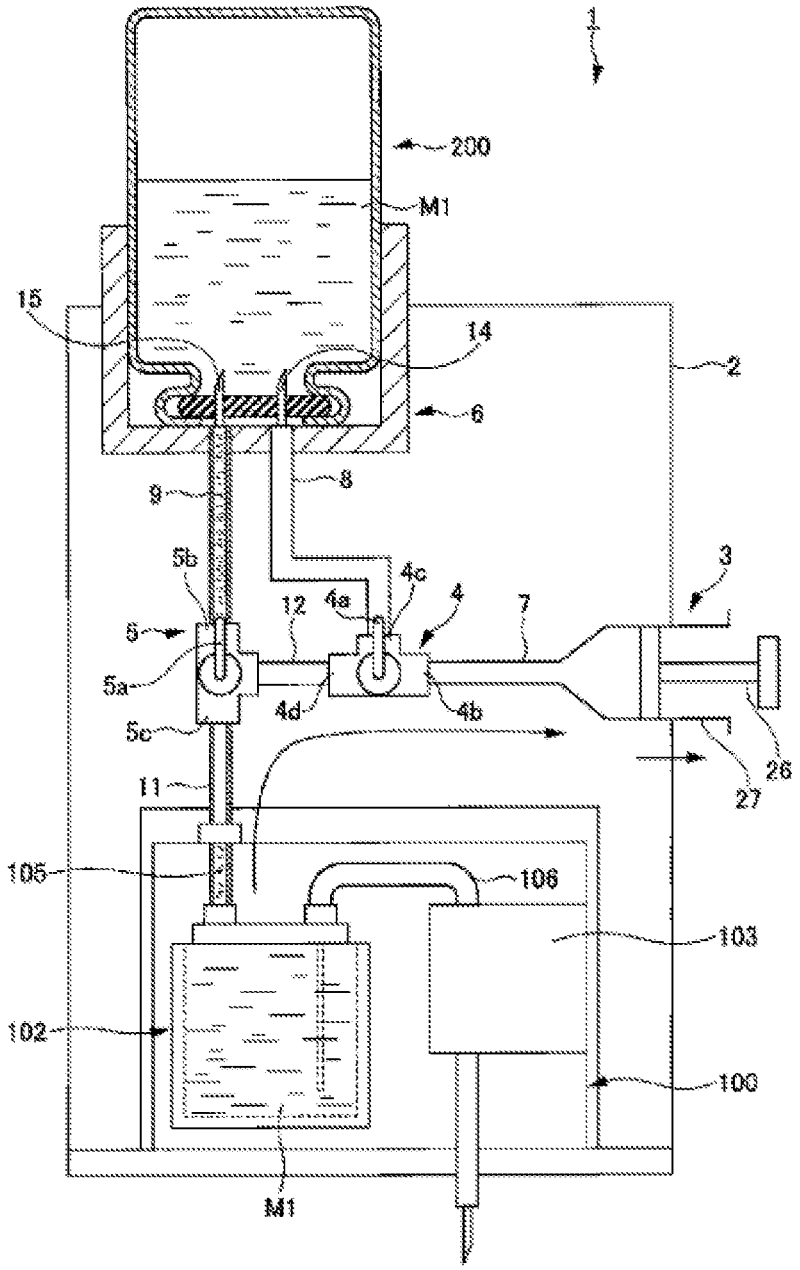
FIG. 4 is a front view illustrating a state in which an air removing operation is performed by the liquid medicine filling device according to the first embodiment.

FIG. 3 is a view illustrating a liquid medicine filling operation and FIG. 4 is a view illustrating an air removing operation.

First, as illustrated in FIG. 2, the liquid medicine administration device 100 is mounted on the mounting unit 22 of the liquid medicine filling device 1. Specifically, the liquid medicine administration device 100 is placed on the pedestal portion 21 of the liquid medicine filling device 1, and the connection needle tube 13 (refer to FIG. 1) pierces the rubber stopper 105*a* of the filling port 105. Note that, at that time, the vial 200 is not yet mounted on the container mounting unit 6. Then, in this state, a sterilizing process is performed on the liquid medicine filling device 1 and the liquid medicine administration device 100. Note that, the liquid medicine storage unit 102 of the liquid medicine administration device 100 is sufficiently deflated.

Next, the stopper member 19 is removed from the supporting unit 17 of the container mounting unit 6 and the vial 200 is mounted on the supporting unit 17. At that time, a position of the pusher 26 of the syringe 3 with respect to the main body portion 27 is adjusted in advance based on an amount of the liquid medicine to be filled in the liquid medicine storage unit 102.

Also, as illustrated in FIGS. 2 and 3, in the first three-way stopcock 4, the switching lever 4*a* is operated in advance to close the third flow path port 4*d* and allow the first flow path port 4*b* and the second flow path port 4*c* to communicate with each other. Therefore, the first ventilation flow conduit 7 communicates with the second ventilation flow conduit 8 via the first three-way stopcock 4. Note that, a flow path from the first ventilation flow conduit 7 and the second ventilation flow conduit 8 to the connection flow conduit 12 via the first three-way stopcock 4 is closed.

Also, in the second three-way stopcock 5, the switching lever 5*a* is operated in advance to allow the first flow path port 5*b*, the second flow path port 5*c*, and the third flow path 5*d* to communicate with one another. However, since the third flow path port 4*d* of the first three-way stopcock 4 is closed, the third flow path port 5*d* of the second three-way stopcock 5 is not communicated with the first ventilation flow conduit 7 and the second ventilation flow conduit 8. Therefore, the first liquid delivery flow conduit 9 communicates with the second liquid delivery flow conduit 11 via the second three-way stopcock 5. Note that, the second three-way stopcock 5 may be operated such that the flow path to the connection flow conduit 12 is closed.

As a result, the tip end 27*b* of the main body portion 27 of the syringe 3 communicates with the inside of the container 201 of the vial 200 via the first ventilation flow conduit 7, the first three-way stopcock 4, the second ventilation flow conduit 8, and the ventilation needle tube 14. Also, the container 201 of the vial 200 communicates with the liquid medicine storage unit 102 via the liquid delivery needle tube 15, the first liquid delivery flow conduit 9, the second three-way stopcock 5, the second liquid delivery flow conduit 11, the connection needle tube 13, and the filling port 105. As a result, a first flow path switching step is completed.

Then, as illustrated in FIG. 3, the pusher 26 is pushed to deliver the air in the main body portion 27 of the syringe 3 to the vial 200 via the first ventilation flow conduit 7, the first three-way stopcock 4, and the second ventilation flow conduit 8. Then, when the air is delivered to the vial 200, an inner pressure of the container 201 of the vial 200 becomes a positive pressure. Therefore, the liquid medicine M1 accommodated in the vial 200 is pressurized by air N1 in the container 201 to be discharged to the first liquid delivery flow conduit 9. Then, the liquid medicine M1 discharged to the first liquid delivery flow conduit 9 passes through the second three-way stopcock 5, the second liquid delivery flow conduit 11, and the filling port 105 to be filled in the liquid medicine storage unit 102.

In order to fill the liquid medicine storage unit 102 with a predetermined amount of liquid medicine M1, it is possible to inject the air of an amount equal to the sum of a volume of the liquid medicine M1 to be filled in the liquid medicine storage unit 102 and a volume from the first liquid delivery flow conduit 9 to the filling opening 112 of the liquid medicine storage unit 102 (refer to FIG. 2) by the syringe 3. Alternatively, it is also possible that a volume scale is provided in the bag unit 110 of the liquid medicine storage unit 102 and the liquid medicine M1 is filled with this scale as a guide. In this case, it is preferable to provide a window through which the scale may be visually recognized on the liquid medicine administration device 100 and the mounting unit 22 of the liquid medicine filling device 1.

Although the air is compressible fluid, when a pushing speed of the pusher 26 is sufficiently small, a speed of air flow is sufficiently small with respect to a sound speed, so that it is possible to suppress compressibility of the air and the air may be handled as substantially incompressible fluid.

When the liquid medicine storage unit 102 is filled with a predetermined amount of liquid medicine M1, a pushing operation of the pusher 26 is finished. As a result, the filling operation of the liquid medicine storage unit 102 with the liquid medicine M1 is finished. However, residual air N2 is accommodated in the bag unit 110 of the liquid medicine storage unit 102 together with the liquid medicine M1. In order to prevent the residual air N2 from entering the user's body, the air removing operation is performed.

Next, the operation of removing the residual air N2 is described with reference to FIG. 4.

First, as illustrated in FIG. 4, the user operates the switching lever 4*a* of the first three-way stopcock 4 to close the second flow path port 4*c* and allow the first flow path port 4*b* and the third flow path port 4*d* to communicate with each other. Also, the user operates the switching lever 5*a* of the second three-way stopcock 5 to close the first flow path port 5*b* and allow the second flow path port 5*c* and the third flow path port 5*d* to communicate with each other.

Therefore, the second liquid delivery flow conduit 11 communicated with the filling port 105 and the first ventilation flow conduit 7 communicated with the main body portion 27 of the syringe 3 are communicated with each other via the first three-way stopcock 4, the connection flow conduit 12, and the second three-way stopcock 5. On the other hand, flow paths to the second ventilation flow conduit 8 and the first liquid delivery flow conduit 9 connected to the vial 200 are closed by the first three-way stopcock 4 and the second three-way stopcock 5. That is, the flow paths to the syringe 3 and the liquid medicine storage unit 102 of the vial 200 are blocked. As a result, a second flow path switching step is completed.

Next, the pusher 26 is pulled from one end to the other end in the axial direction of the main body portion 27. The residual air N2 in the liquid medicine storage unit 102 is drawn to the main body portion 27 of the syringe 3 via the filling port 105, the second liquid delivery flow conduit 11, the second three-way stopcock 5, the connection flow conduit 12, the first three-way stopcock 4, and the first ventilation flow conduit 7. When the residual air N2 in the liquid medicine storage unit 102 is fully removed, the operation of the pusher 26 is finished. Then, the connection needle tube 13 (refer to FIG. 1) is pulled out from the rubber stopper 105*a* of the filling port 105 and the liquid medicine administration device 100 is detached from the mounting unit 22 (refer to FIG. 1). As a result, the filling operation of the liquid medicine storage unit 102 with the liquid medicine M1 and the air removing operation are completed.

According to the liquid medicine filling device 1 of this embodiment, it is possible to perform the liquid medicine filling operation and the air removing operation by one syringe 3, so that it is possible to reduce a size of an entire device. Note that, the first flow path switching step may also be performed before mounting the liquid medicine administration device 100 on the liquid medicine filling device 1 or after the liquid medicine administration device 100 is mounted on the liquid medicine filling device 1.

1-3. Variation

Next, a variation of a liquid medicine filling device 1 is described with reference to FIGS. 5A and 5B.

Figure 5A:
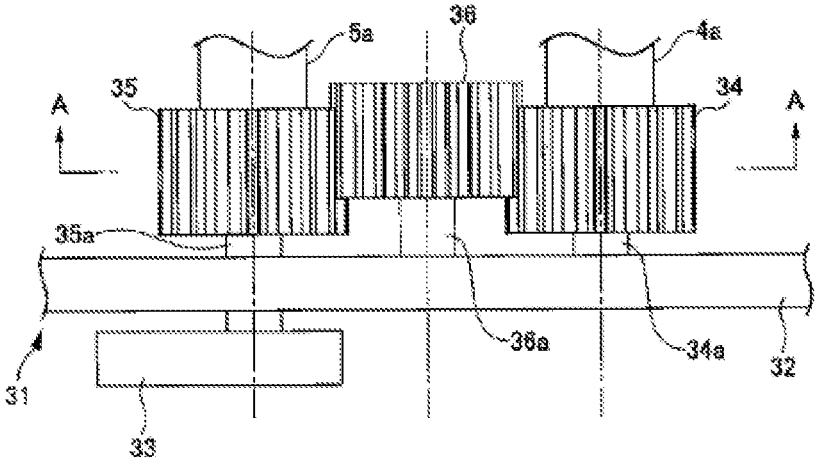
Figure 5B:
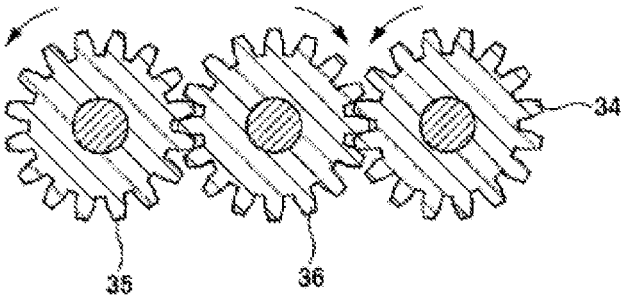

FIGS. 5A and 5B are views illustrating an interlocking mechanism.

As illustrated in FIG. 3 and FIG. 4, when removing air after filling, a user needs to operate a switching lever 4*a* of a first three-way stopcock 4 and a switching lever 5*a* of a second three-way stopcock 5, respectively. Furthermore, there are four types of switching positions of the switching levers 4*a* and 5*a*: in a case of closing first flow path ports 4*b* and 5*b*, closing second flow path ports 4*c* and 5*c*, closing third flow path ports 4*d* and 5*d*, and closing no flow path port. Furthermore, since the first three-way stopcock 4 and the second three-way stopcock 5 are combined, there is a plurality of types. In this manner, since there is a plurality of types switching positions, erroneous settings might be caused. In order to prevent such erroneous settings, for example, an interlocking mechanism 31 as illustrated in FIGS. 5A and 5B may be used.

As illustrated in FIGS. 5A and 5B, the interlocking mechanism 31 includes a support plate 32, an operating lever 33, a first gear 34, a second gear 35, and a transmission gear 36. The first gear 34, the second gear 35, and the transmission gear 36 are rotatably supported by the support plate 32 via rotation shafts 34*a*, 35*a*, 36*a*, respectively.

The transmission gear 36 is arranged between the first gear 34 and the second gear 35 to mesh with the first gear 34 and the second gear 35. When the second gear 35 rotates, rotational force thereof is transmitted to the first gear 34 via the transmission gear 36. Then, the first gear 34 and the second gear 35 rotate in the same direction.

Also, the numbers of teeth of the first gear 34, the second gear 35, and the transmission gear 36 are set to the same number. Therefore, rotation angles of the first gear 34, the second gear 35, and the transmission gear 36 are the same.

Also, the switching lever 4*a* of the first three-way stopcock 4 is connected the first gear 34. Therefore, when the first gear 34 rotates, the switching lever 4*a* of the first three-way stopcock 4 rotates, and a flow path to be blocked by the first three-way stopcock 4 is switched.

Also, the switching lever 5*a* of the second three-way stopcock 5 is connected the second gear 35. Therefore, when the second gear 35 rotates, the switching lever 5*a* of the second three-way stopcock 5 rotates, and a flow path to be blocked by the second three-way stopcock 5 is switched.

Furthermore, the rotation shaft 35*a* of the second gear 35 is connected to the operating lever 33. Therefore, when the operating lever 33 is operated, the second gear 35 rotates.

For example, when the operating lever 33 is rotated by 90 degrees, the second gear 35 also rotates by 90 degrees. Then, the rotational force of the second gear 35 is transmitted to the first gear 34 via the transmission gear 36 and the first gear 34 also rotates by 90 degrees in the same direction as the second gear 35. Also, the switching lever 4*a* of the first three-way stopcock 4 and the switching lever 5*a* of the second three-way stopcock 5 rotate by 90 degrees in the same direction. As a result, the positions of the switching levers 4*a* and 5*a* of the first three-way stopcock 4 and the second three-way stopcock 5 may be simultaneously changed from the positions illustrated in FIG. 3 to the positions illustrated in FIG. 4. As a result, by using the interlocking mechanism 31 described above, it is possible to prevent the erroneous settings of the switching levers 4*a* and 5*a* from occurring when an air removing operation is performed after a filling operation.

Note that, although the example in which the numbers of teeth of the first gear 34, the second gear 35, and the transmission gear 36 of the interlocking mechanism 31 are set to the same number is described in the example illustrated in FIGS. 5A and 5B, there is no limitation and the numbers of teeth of the first gear 34, the second gear 35, and the transmission gear 36 may be set to different numbers. Also, the number of gears forming the interlocking mechanism is not limited to three, and a plurality of transmission gears 36 may also be provided.

2. Second Embodiment

Next, a second embodiment of a liquid medicine filling device is described with reference to FIG. 6.

Figure 6:
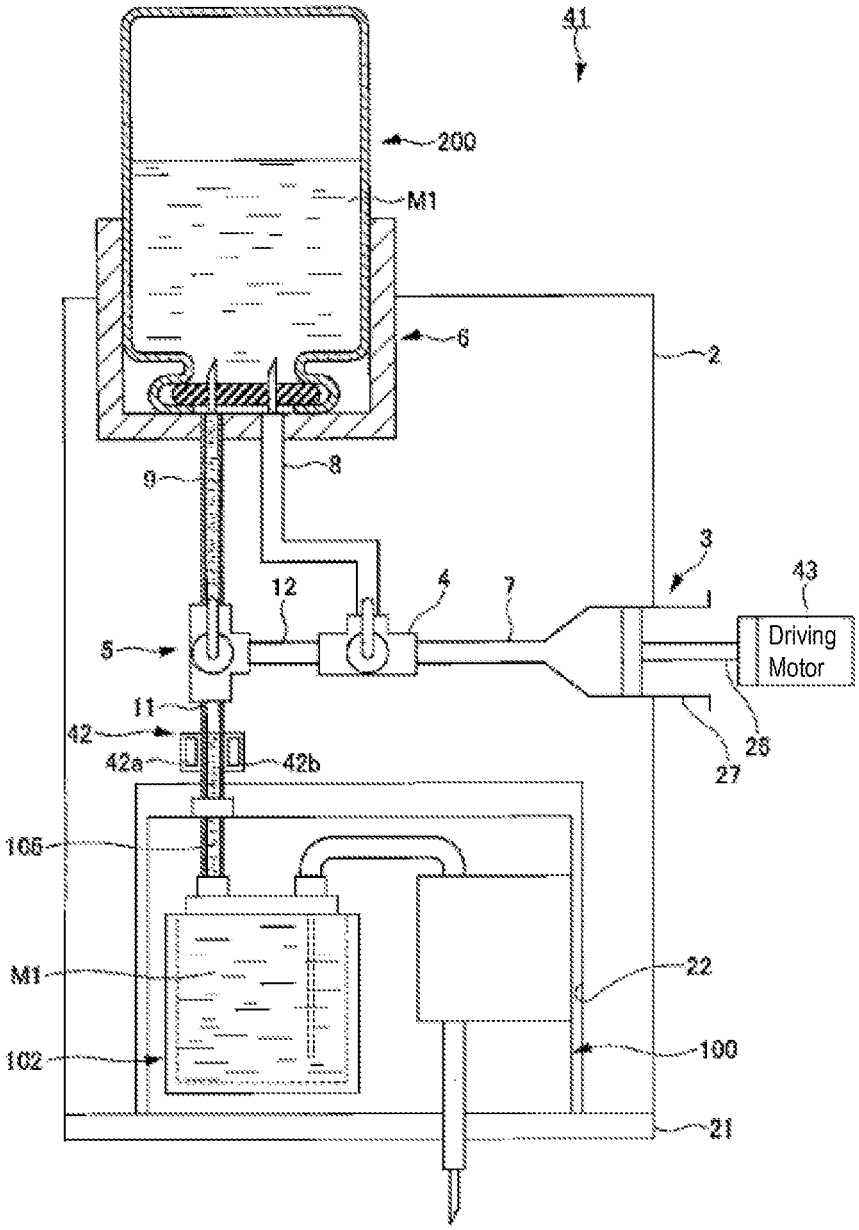
FIG. 6 is a front view illustrating a schematic configuration of a liquid medicine filling device according to a second embodiment.

FIG. 6 is a view illustrating a schematic configuration of the liquid medicine filling device according to the second embodiment.

The liquid medicine filling device according to the second embodiment is obtained by providing a liquid medicine detecting sensor on a liquid medicine filling device 1 according to the first embodiment and further driving a pusher by a driving motor. Therefore, the liquid medicine detecting sensor and the driving motor are herein described, and the same reference signs are assigned to parts common to those of the liquid medicine filling device 1 according to the first embodiment and the description thereof is not repeated.

As illustrated in FIG. 6, a liquid medicine filling device 41 includes a liquid medicine detecting sensor 42 and a driving motor 43. The liquid medicine detecting sensor 42 is provided on an end on a filling port 105 side of a second liquid delivery flow conduit 11. The liquid medicine detecting sensor 42 is, for example, an optical sensor formed of a light emitting unit 42*a* which emits light and a light receiving unit 42*b* which receives the light from the light emitting unit 42*a*. The liquid medicine detecting sensor 42 detects a liquid medicine M1 passing through the second liquid delivery flow conduit 11. Then, the liquid medicine detecting sensor 42 transmits detected information to a control unit not illustrated.

Note that, the liquid medicine detecting sensor 42 is not limited to the optical sensor, and various other sensors may also be used.

Also, the driving motor 43 is provided on a pusher 26 of a syringe 3. The driving motor 43 is formed of, for example, a direct-acting stepping motor. The driving motor 43 is driven based on a drive signal from the control unit not illustrated to operate the pusher 26 in an axial direction of a main body portion 27. As a result, a moving amount of the pusher 26 may be finely set by the driving motor 43 as compared with a case where this is manually operated by a user, and a more accurate filling operation may be performed.

Note that, the driving motor 43 is not limited to the direct-acting stepping motor, and a rotary stepping motor and a plurality of gears may be used to operate the pusher 26.

Furthermore, at the time of air removing operation, when residual air N2 is drawn from a liquid medicine storage unit 102 and the liquid medicine M1 filled in the liquid medicine storage unit 102 reaches the second liquid delivery flow conduit 11, the liquid medicine detecting sensor 42 detects the liquid medicine M1 passing through the second liquid delivery flow conduit 11. Then, the liquid medicine detecting sensor 42 transmits detected information to the control unit not illustrated. The control unit not illustrated stops the drive of the driving motor 43 when receiving the information that the liquid medicine M1 is detected from the liquid medicine detecting sensor 42. As a result, the air removing operation may be automatically performed, and the filling operation and the air removing operation may be easily performed.

Also, since there is one syringe 3, one driving motor 43 for operating the pusher 26 is sufficient, and a size of an entire device may be reduced.

Since other configurations are similar to those of the liquid medicine filling device 1 according to the first embodiment, the description thereof is not repeated. An action and effect similar to that those of the liquid medicine filling device 1 according to the first embodiment described above may also be obtained by the liquid medicine filling device 41 having such a configuration.

3. Third Embodiment

Next, a third embodiment of a liquid medicine filling device is described with reference to FIGS. 7A to 8B.

FIGS. 7A to 8B are views illustrating a schematic configuration of the liquid medicine filling device according to the third embodiment.

The liquid medicine filling device according to the third embodiment is obtained by providing a third three-way stopcock which is a flow path blocking unit on a liquid medicine filling device 1 according to the first embodiment. Therefore, the third three-way stopcock being the flow path blocking unit is herein described, and the same reference signs are assigned to parts common to those of the liquid medicine filling device 1 according to the first embodiment and the description thereof is not repeated.

Figure 7B:
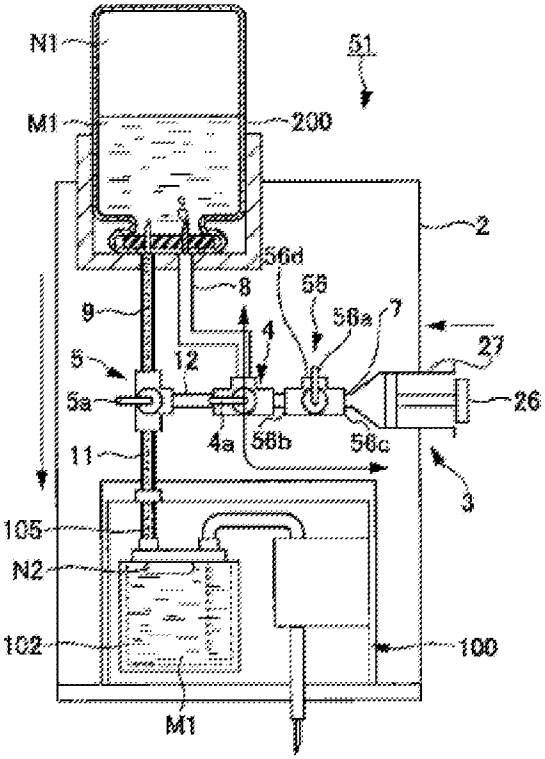
Figure 7A:
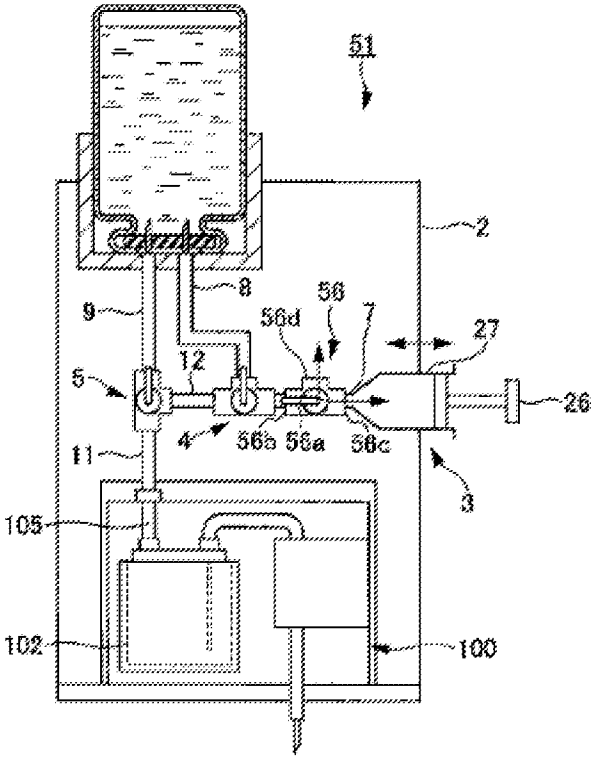

As illustrated in FIG. 7A, a liquid medicine filling device 51 includes a third three-way stopcock 56 being an example of the flow path blocking unit. The third three-way stopcock 56 is provided in the middle of a first ventilation flow conduit 7. The third three-way stopcock 56 includes a switching lever 56*a*, a first flow path port 56*b*, a second flow path port 56*c*, and a third flow path port 56*d*. By operating the switching lever 56*a*, one of the first flow path port 56*b*, the second flow path port 56*c*, and the third flow path port 56*d* is closed, and the remaining two flow path ports are communicated with each other.

The first flow path port 56*b* is connected to a first three-way stopcock 4 side in the first ventilation flow conduit 7 and the second flow path port 56*c* is connected to a syringe 3 side in the first ventilation flow conduit 7. Also, the third flow path port 56*d* is opened to the outside.

Also, before filling the liquid medicine M1, the third three-way stopcock 56 is such that the switching lever 56*a* is operated to close the first flow path port 56*b*, and the second flow path port 56*c* communicates with the third flow path 56*d* opened to the outside.

Therefore, a flow path from a main body portion 27 of the syringe 3 to other flow paths 8, 9, 11, and 12, a vial 200, and a liquid medicine storage unit 102 of a liquid medicine administration device 100 is blocked. Therefore, in a state illustrated in FIG. 7A, even if a pusher 26 is operated, this does not affect the other flow paths 8, 9, 11, and 12, the vial 200, and the liquid medicine storage unit 102 of the liquid medicine administration device 100. As a result, a position of the pusher 26 with respect to the main body portion 27 may be freely set.

When setting of the position of the pusher 26 is finished, as illustrated in FIG. 7B, the switching lever 56*a* of the third three-way stopcock 56 is operated to close the third flow path port 56*d* and allow the first flow path port 56*b* to communicate with the second flow path port 56*c*. Note that, the positions of the switching levers 4*a* and 5*a* of the first three-way stopcock 4 and the second three-way stopcock 5 are operated to be in the same positions as the positions illustrated in FIG. 3.

As a result, the main body portion 27 of the syringe 3 communicates with the inside of a container 201 of the vial 200 via the first ventilation flow conduit 7, the third three-way stopcock 56, the first three-way stopcock 4, the second ventilation flow conduit 8, and the ventilation needle tube 14 as in the stage illustrated in FIG. 3. Then, by pushing the pusher 26, it is possible to fill the liquid medicine storage unit 102 with a liquid medicine M1.

Also, when the liquid medicine M1 is further filled after the pusher 26 is fully pushed, as illustrated in FIG. 7A, the switching lever 56*a* of the third three-way stopcock 56 is operated again to close the first flow path port 56*b* and allow the second flow path port 56*c* to communicate with the third flow path port 56*d*. As a result, the position of the pusher 26 may be adjusted again. As a result, since a filling operation may be performed in a plurality of times, a volume of the main body portion 27 corresponding to a filling amount of each time may be reduced, and it is possible to reduce a size of an entire device.

Figure 8B:
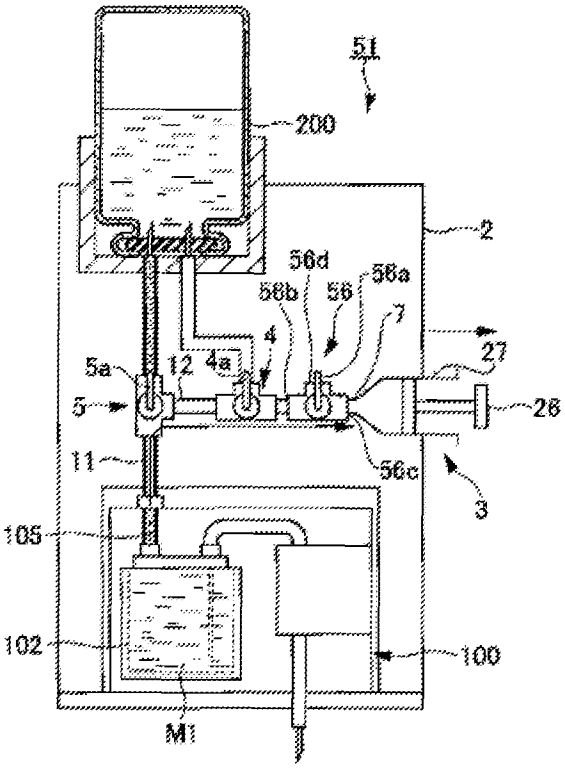
Figure 8A:
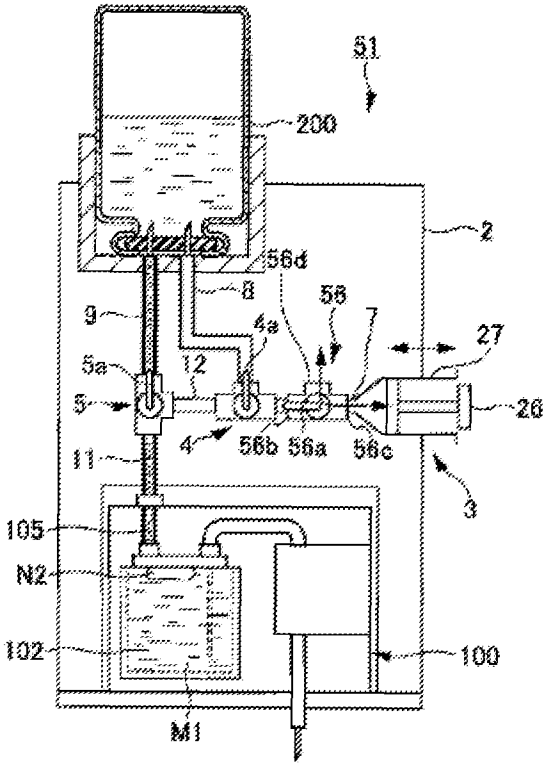

Also, when residual air N2 is removed from the liquid medicine storage unit 102, as illustrated in FIG. 8A, first, the switching lever 56*a* of the third three-way stopcock 56 is operated to close the first flow path port 56*b* and allow the second flow path port 56*c* to communicate with the third flow path port 56*d*. As a result, the position of the pusher 26 may be freely set according to the amount of the residual air N2.

When the setting of the position of the pusher 26 is finished, as illustrated in FIG. 8B, the switching lever 56*a* of the third three-way stopcock 56 is operated to close the third flow path port 56*d* and allow the first flow path port 56*b* to communicate with the second flow path port 56*c*. Note that, the positions of the switching levers 4*a* and 5*a* of the first three-way stopcock 4 and the second three-way stopcock 5 are operated to be in the same positions as the positions illustrated in FIG. 4. As a result, the main body portion 27 of the syringe 3 communicates with the liquid medicine storage unit 102 via the first ventilation flow conduit 7, the third three-way stopcock 56, the first three-way stopcock 4, the connection flow conduit 12, the second three-way stopcock 5, the second liquid delivery flow conduit 11, and a filling port 105. Then, by pulling the pusher 26, it is possible to draw the residual air N2 in the liquid medicine storage unit 102.

Furthermore, when the air is further removed after the pusher 26 is fully pulled, as illustrated in FIG. 8A, the switching lever 56*a* of the third three-way stopcock 56 is operated to close the first flow path port 56*b* and allow the second flow path port 56*c* to communicate with the third flow path port 56*d*. As a result, the position of the pusher 26 may be adjusted again.

Since other configurations are similar to those of the liquid medicine filling device 1 according to the first embodiment, the description thereof is not repeated. An action and effect similar to those of the liquid medicine filling device 1 according to the first embodiment described above may also be obtained by the liquid medicine filling device 51 having such a configuration.

4. Fourth Embodiment

Next, a fourth embodiment of a liquid medicine filling device is described with reference to FIGS. 9A and 9B.

Figure 9B:
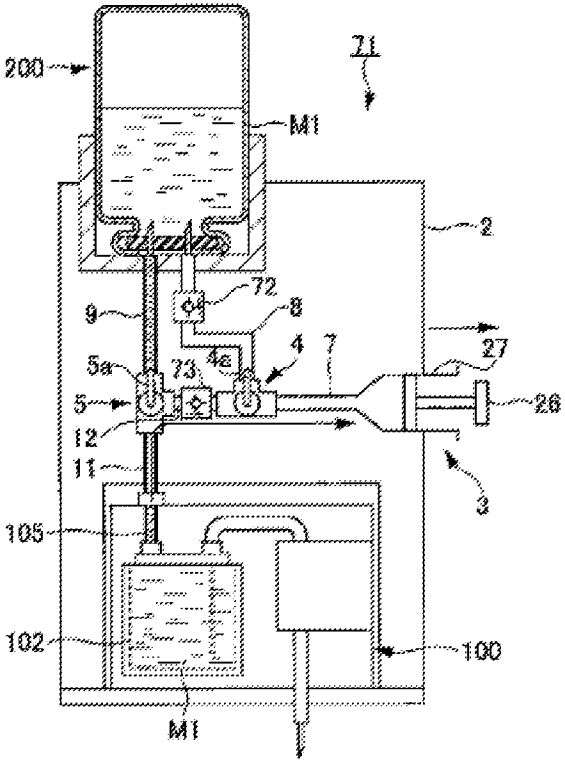
Figure 9A:
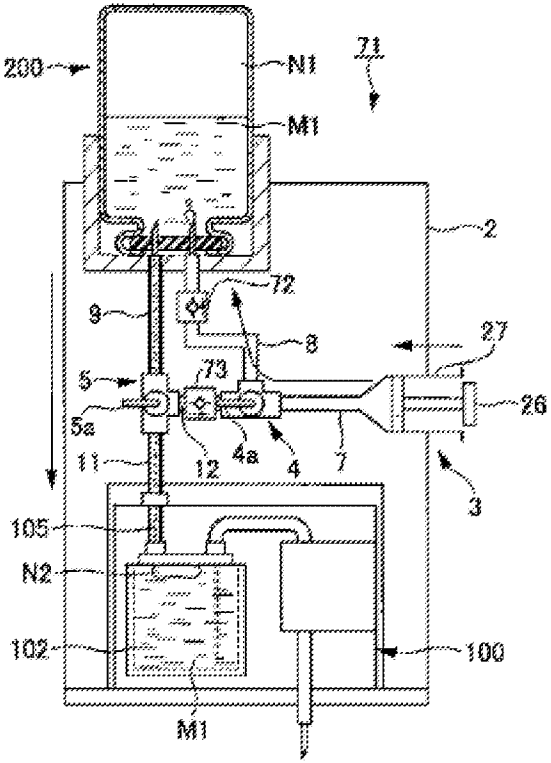

FIG. 9A is a view illustrating a liquid medicine filling operation in the liquid medicine filling device according to the fourth embodiment, and FIG. 9B is a view illustrating an air removing operation in the liquid medicine filling device according to the fourth embodiment.

The liquid medicine filling device according to the fourth embodiment is obtained by providing two check valves on a liquid medicine filling device 1 according to the first embodiment. Therefore, the check valve is herein described, and the same reference signs are assigned to parts common to those of the liquid medicine filling device 1 according to the first embodiment and the description thereof is not repeated.

As illustrated in FIGS. 9A and 9B, a liquid medicine filling device 71 includes a first check valve 72 and a second check valve 73. The first check valve 72 is provided on a second ventilation flow conduit 8. The first check valve 72 regulates a flow of air and a liquid medicine M1 flowing from a ventilation needle tube 14 in the second ventilation flow conduit 8 toward a first three-way stopcock 4. Therefore, the air passing through the second ventilation flow conduit 8 flows only from the first three-way stopcock 4 toward a vial 200 by the first check valve 72.

The second check valve 73 is provided on a connection flow conduit 12. The second check valve 73 regulates a flow of the air from the first three-way stopcock 4 to a second three-way stopcock 5 in the connection flow conduit 12, that is, from a first ventilation flow conduit 7 to a first liquid delivery flow conduit 9 and the second liquid delivery flow conduit 11. Therefore, the air passing through the connection flow conduit 12 flows only from the second three-way stopcock 5 toward the first three-way stopcock 4 by the second check valve 73.

As a result, as illustrated in FIG. 9A, even if a pusher is erroneously pulled during the liquid medicine filling operation, it is possible to regulate the flow of the liquid medicine M1 from the vial 200 via the second ventilation flow conduit 8 toward the first three-way stopcock 4 by the first check valve 72.

Also, as illustrated in FIG. 9B, even if the pusher is erroneously pushed during the air removing operation, it is possible to regulate the flow of the air pushed out from a main body portion 27 of a syringe 3 via the connection flow conduit 12 toward the second three-way stopcock 5 and a liquid medicine storage unit 102.

Since other configurations are similar to those of the liquid medicine filling device 1 according to the first embodiment, the description thereof is not repeated. An action and effect similar to that those of the liquid medicine filling device 1 according to the first embodiment described above may also be obtained by the liquid medicine filling device 71 having such a configuration.

5. Fifth Embodiment

Next, a fifth embodiment of a liquid medicine filling device is described with reference to FIGS. 10A and 10B.

Figure 10B:
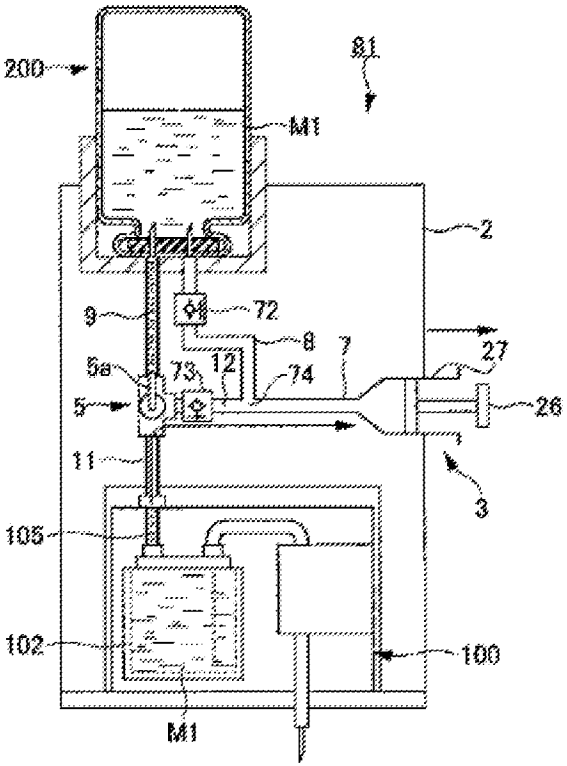
Figure 10A:
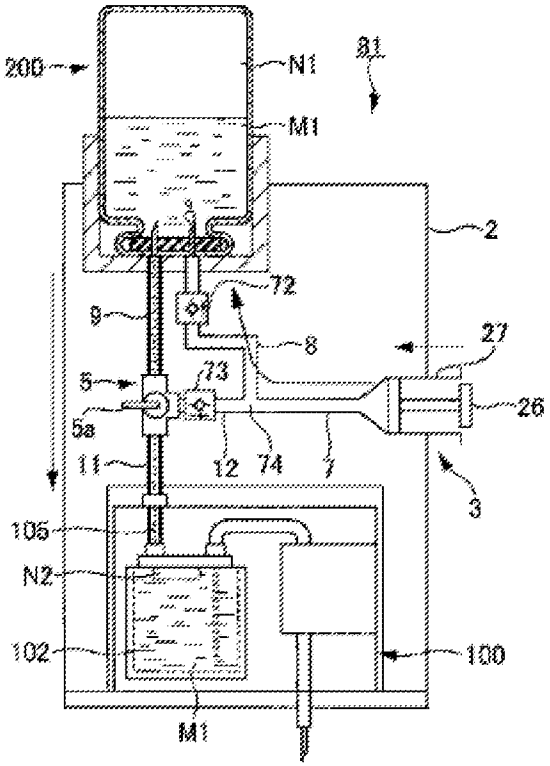

FIGS. 10A and 10B are views illustrating a schematic configuration of the liquid medicine filling device according to the fifth embodiment.

The liquid medicine filling device according to the fifth embodiment is obtained by removing a first three-way stopcock 4 from a liquid medicine filling device 71 according to the fourth embodiment. Therefore, the same reference signs are assigned to parts common to those of the liquid medicine filling device 71 according to the fourth embodiment and the description thereof is not repeated.

As illustrated in FIGS. 10A and 10B, in a liquid medicine filling device 81, a first check valve 72 is provided on a second ventilation flow conduit 8 and a second check valve 73 is provided on a connection flow conduit 12. Also, the first ventilation flow conduit 7, the second ventilation flow conduit 8, and the connection flow conduit 12 are connected to one another by a T-shaped pipe 74.

According to the liquid medicine filling device 81, as illustrated in FIG. 10A, when filling a liquid medicine M1, moving of air pushed out from a main body portion 27 of a syringe 3 to a second three-way stopcock 5, a first liquid delivery flow conduit 9, and a second liquid delivery flow conduit 11 is regulated by the second check valve 73. Therefore, the air pushed out from the main body portion 27 of the syringe 3 passes through the pipe 74 and the second ventilation flow conduit 8 to be delivered to a vial 200. Therefore, a filling operation of the liquid medicine M1 may also be performed by the liquid medicine filling device 81 having such a configuration as is the case with the liquid medicine filling device 1 according to the first embodiment.

Also, as illustrated in FIG. 10B, when removing air, the flow of the liquid medicine M1 from the vial 200 toward the pipe 74, the first ventilation flow conduit 7, and the connection flow conduit 12 is regulated by the first check valve 72. Therefore, an air removing operation may also be performed by the liquid medicine filling device 81 having such a configuration as is the case with the liquid medicine filling device 1 according to the first embodiment.

Also, according to the liquid medicine filling device 81 according to the fifth embodiment, the number of three-way stopcocks may be reduced as compared with that of the liquid medicine filling device 1 according to the first embodiment. As a result, it is possible to reduce a process of operating the three-way stopcock during the liquid medicine filling operation or the air removing operation.

Since other configurations are similar to those of the liquid medicine filling device 1 according to the first embodiment, the description thereof is not repeated. An action and effect similar to that those of the liquid medicine filling device 1 according to the first embodiment described above may also be obtained by the liquid medicine filling device 81 having such a configuration.

Embodiments of the present invention including their action and effect are heretofore described. However, the liquid medicine filling device according to the present invention is not limited to the above-described embodiments, and various modifications made be made within the scope of the gist of the invention recited in claims.

For example, the liquid medicine filling device 41 according to the second embodiment may be provided with the third three-way stopcock 56 which is the flow path blocking unit as is the case with the liquid medicine filling device 51 according to the third embodiment and the first check valve 72 and the second check valve 73 as is the case with the liquid medicine filling device 71 according to the fourth embodiment. Furthermore, the liquid medicine filling device 81 according to the fifth embodiment may be provided with the liquid medicine detecting sensor, the driving motor, and the flow path blocking unit.

Also, although the example in which the three-way stopcock is used as the flow path switching unit and the flow path blocking unit is described, there is no limitation. For example, a movable valve may be provided in a connection portion between the ventilation flow conduit and the connection flow conduit, a connection portion between the liquid delivery flow conduit and the connection flow conduit, and the ventilation flow conduit. By changing the direction of this valve, the flow paths through which the air and liquid medicine flow may be switched or blocked.

In the above-described embodiments, the example in which insulin is applied as the liquid medicine to be filled using the liquid medicine filling device is described, but there is no limitation. As the liquid medicine to be filled, other various liquid medicines such as analgesic, anticancer therapeutic medicine, HIV drugs, iron chelators, pulmonary hypertension therapeutic medicines and the like may be used.

REFERENCE NUMERAL LIST 1, 41, 51, 71, 81 Liquid medicine filling device
2 Housing
3 Syringe
4 First three-way stopcock (first flow path switching unit)
4*a* Switching lever
4*b* First flow path port
4*c* Second flow path port
4*d* Third flow path port
5 Second three-way stopcock (second flow path switching unit)
5*a* Switching lever
5*b* First flow path port
5*c* Second flow path port
5*d* Third flow path port
6 Container mounting unit
7 First ventilation flow conduit
8 Second ventilation flow conduit
9 First liquid delivery flow conduit
11 Second liquid delivery flow conduit
12 Connection flow conduit
13 Connection needle tube
14 Ventilation needle tube
15 Liquid delivery needle tube
17 Supporting unit
21 Pedestal portion
22 Mounting unit
26 Pusher
27 Main body portion
27*a* Cylindrical hole
27*b* Tip end
31 Interlocking mechanism
32 Support plate
33 Operating lever
34 First gear
35 Second gear
36 Transmission gear
42 Liquid medicine detecting sensor
43 Driving motor
56 Third three-way stopcock (flow path blocking unit)
56*a* Switching lever
56*b* First flow path port
56*c* Second flow path port
56*d* Third flow path port
72 First check valve
73 Second check valve
74 Pipe
100 Liquid medicine administration device
102 Liquid medicine storage unit
103 Pump unit
104 Puncture needle
105 Filling port
200 Vial (liquid medicine container)
M1 Liquid medicine
N1 Air
N2 Residual air

What is claimed is:

1. A liquid medicine filling device for filling a liquid medicine storage unit of a liquid medicine administration device with a liquid medicine, the liquid medicine filling device comprising:

a liquid delivery flow conduit configured to be connected to (i) a liquid medicine container accommodating the liquid medicine, and (i) a filling port of the liquid medicine storage unit;

a ventilation flow conduit configured to be connected to the liquid medicine container;

a syringe connected to the ventilation flow conduit, the syringe being configured to discharge air to the ventilation flow conduit or draw air from the ventilation flow conduit;

a connection flow conduit that connects the ventilation flow conduit and the liquid delivery flow conduit;

a first flow path switching unit located in a connection portion between the ventilation flow conduit and the connection flow conduit and configured to switch between (i) a flow path for filling, through which the syringe communicates with the liquid medicine container via the ventilation flow conduit, and (ii) a flow path for air removal, through which the syringe communicates with the connection flow conduit via the ventilation flow conduit; and a second flow path switching unit located in a connection portion between the liquid delivery flow conduit and the connection flow conduit, the second flow path switching unit being configured to switch between (i) a flow path for filling, through which the liquid medicine container communicates with the liquid medicine storage unit via the liquid delivery path, and (ii) a flow path for air removal, through which the liquid medicine storage unit communicates with the connection flow conduit via the liquid delivery flow conduit.

2. The liquid medicine filling device according to claim 1, further comprising:

an interlocking mechanism configured to interlock a switching operation of the flow path by the first flow path switching unit with a switching operation of the flow path by the second flow path switching unit.

3. The liquid medicine filling device according to claim 2, further comprising:

a liquid medicine detecting sensor configured to detect the liquid medicine, the liquid medicine detecting sensor being located on a filling port side of the second flow path switching unit in the liquid delivery flow conduit.

4. The liquid medicine filling device according to claim 3, further comprising:

a flow path blocking unit configured to block a flow path that communicates with the syringe, the flow path blocking unit being provided on a syringe side of the first flow path switching unit in the ventilation flow conduit.

5. The liquid medicine filling device according to claim 4, further comprising:

a first check valve located on a liquid medicine container side of the first flow path switching unit in the ventilation flow conduit; and a second check valve located in the connection flow conduit, wherein the first check valve is configured to regulate a flow of air and the liquid medicine from the liquid medicine container toward the first flow path switching unit in the ventilation flow conduit, and wherein the second check valve is configured to regulate a flow of the air from the ventilation flow conduit to the liquid delivery flow conduit in the connection flow conduit.

6. The liquid medicine filling device according to claim 3, further comprising:

a first check valve located on a liquid medicine container side of the first flow path switching unit in the ventilation flow conduit; and a second check valve located in the connection flow conduit, wherein the first check valve is configured to regulate a flow of air and the liquid medicine from the liquid medicine container toward the first flow path switching unit in the ventilation flow conduit, and wherein the second check valve is configured to regulate a flow of the air from the ventilation flow conduit to the liquid delivery flow conduit in the connection flow conduit.

7. The liquid medicine filling device according to claim 2, further comprising:

a flow path blocking unit configured to block a flow path that communicates with the syringe, the flow path blocking unit being provided on a syringe side of the first flow path switching unit in the ventilation flow conduit.

8. The liquid medicine filling device according to claim 2, further comprising:

a first check valve located on a liquid medicine container side of the first flow path switching unit in the ventilation flow conduit; and a second check valve located in the connection flow conduit, wherein the first check valve is configured to regulate a flow of air and the liquid medicine from the liquid medicine container toward the first flow path switching unit in the ventilation flow conduit, and wherein the second check valve is configured to regulate a flow of the air from the ventilation flow conduit to the liquid delivery flow conduit in the connection flow conduit.

9. The liquid medicine filling device according to claim 1, further comprising:

a liquid medicine detecting sensor configured to detect the liquid medicine, the liquid medicine detecting sensor being located on a filling port side of the second flow path switching unit in the liquid delivery flow conduit.

10. The liquid medicine filling device according to claim 9, further comprising:

a flow path blocking unit configured to block a flow path that communicates with the syringe, the flow path blocking unit being provided on a syringe side of the first flow path switching unit in the ventilation flow conduit.

11. The liquid medicine filling device according to claim 9, further comprising:

a first check valve located on a liquid medicine container side of the first flow path switching unit in the ventilation flow conduit; and a second check valve located in the connection flow conduit, wherein the first check valve is configured to regulate a flow of air and the liquid medicine from the liquid medicine container toward the first flow path switching unit in the ventilation flow conduit, and wherein the second check valve is configured to regulate a flow of the air from the ventilation flow conduit to the liquid delivery flow conduit in the connection flow conduit.

12. The liquid medicine filling device according to claim 1, further comprising:

a flow path blocking unit configured to block a flow path that communicates with the syringe, the flow path blocking unit being provided on a syringe side of the first flow path switching unit in the ventilation flow conduit.

13. The liquid medicine filling device according to claim 1, further comprising:

a first check valve located on a liquid medicine container side of the first flow path switching unit in the ventilation flow conduit; and a second check valve located in the connection flow conduit, wherein the first check valve is configured to regulate a flow of air and the liquid medicine from the liquid medicine container toward the first flow path switching unit in the ventilation flow conduit, and wherein the second check valve is configured to regulate a flow of the air from the ventilation flow conduit to the liquid delivery flow conduit in the connection flow conduit.

14. The liquid medicine filling device according to claim 1, wherein the liquid medicine storage unit is formed of a flexible material.

15. The liquid medicine filling device according to claim 1, wherein the liquid medicine storage unit is configured to contract and expand according to a change in internal volume.

16. A liquid medicine filling device for filling a liquid medicine storage unit of a liquid medicine administration device with a liquid medicine, the liquid medicine filling device comprising:

a liquid delivery flow conduit configured to be connected to (i) a liquid medicine container accommodating the liquid medicine, and (ii) a filling port of the liquid medicine storage unit;

a ventilation flow conduit configured to be connected to the liquid medicine container;

a syringe connected to the ventilation flow conduit, the syringe being configured to discharge air to the ventilation flow conduit or draw air from the ventilation flow conduit;

a connection flow conduit that connects the ventilation flow conduit and the liquid delivery flow conduit;

a flow path switching unit located in a connection portion between the liquid delivery flow conduit and the connection flow conduit and configured to switch between (i) a flow path for filling, through which the liquid medicine container communicates with the liquid medicine storage unit via the liquid delivery flow conduit, and (ii) a flow path for air removal, through which the liquid medicine storage unit communicates with the connection flow conduit via the liquid delivery flow conduit;

a first check valve located on a liquid medicine container side of a connection portion to the connection flow conduit in the ventilation flow conduit; and a second check valve located in the connection flow conduit, wherein the first check valve is configured to regulate a flow of the air and the liquid medicine from the liquid medicine container to the connection flow conduit and the syringe in the ventilation flow conduit, and wherein the second check valve is configured to regulate a flow of the air from the ventilation flow conduit to the liquid delivery flow conduit in the connection flow conduit.

17. The liquid medicine filling device according to claim 15, wherein the liquid medicine storage unit is formed of a flexible material.

18. The liquid medicine filling device according to claim 15, wherein the liquid medicine storage unit contracts and expands according to a change in internal volume.

19. A liquid medicine filling method comprising:

providing a liquid medicine administration device comprising a liquid medicine storage unit that comprises a filling port;

providing a liquid medicine filling comprising a liquid delivery flow conduit, a ventilation flow conduit, and a connection flow conduit connecting the ventilation flow conduit and the liquid delivery flow conduit, wherein the liquid delivery flow path is connected to (i) a liquid medicine container accommodating the liquid medicine, and (ii) the filling port of the liquid medicine storage unit, and the ventilation flow conduit is connected to the liquid medicine container; and filling the liquid medicine storage unit of the liquid medicine administration device with the liquid medicine by performing steps comprising:

a first flow path switching step comprising:

operating a first flow path switching unit located in a connection portion between the connection flow conduit and the ventilation flow conduit to allow a syringe of the liquid medicine filling device to communicate with the liquid medicine container via the ventilation flow conduit and to close a flow path from the ventilation flow conduit to the connection flow conduit, and operating a second flow path switching unit provided in a connection portion between the liquid delivery flow conduit and the connection flow conduit to allow the liquid medicine container to communicate with the liquid medicine storage unit via the liquid delivery flow conduit and to close a flow path from the liquid delivery flow conduit to the connection flow conduit;

a step comprising operating the syringe to fill the liquid medicine storage unit with the liquid medicine accommodated in the liquid medicine container;

a second flow path switching step comprising:

operating the first flow path switching unit to allow the syringe to communicate with the connection flow conduit via the ventilation flow conduit and to close a flow path from the syringe to the liquid medicine container, and operating the second flow path switching unit to allow the liquid medicine storage unit to communicate with the connection flow conduit via the liquid delivery flow conduit and close a flow path from the liquid medicine container to the liquid medicine storage unit; and a step of operating the syringe to discharge residual air remaining in the liquid medicine container.

20. A liquid medicine filling method comprising:

providing a liquid medicine administration device comprising a liquid medicine storage unit that comprises a filling port;

providing a liquid medicine administration device comprising a liquid delivery flow conduit, a ventilation flow conduit, and a connection flow conduit connecting the ventilation flow conduit and the liquid delivery flow conduit, wherein the liquid delivery flow conduit is connected to (i) a liquid medicine container accommodating the liquid medicine, and (ii) the filling port of the liquid medicine storage unit, and the ventilation flow conduit is connected to the liquid medicine container;

filling the liquid medicine storage unit of the liquid medicine administration device with the liquid medicine, by performing steps comprising:

a first flow path switching step comprising operating a flow path switching unit provided in a connection portion between the connection flow conduit connecting to allow the liquid medicine container to communicate with the liquid medicine storage unit via the liquid delivery flow conduit;

a step comprising operating a syringe of the liquid medicine filling device to fill the liquid medicine storage unit with the liquid medicine accommodated in the liquid medicine container;

a second flow path switching step comprising operating the flow path switching unit to allow the liquid medicine storage unit to communicate with the connection flow conduit via the liquid delivery flow conduit; and a step comprising operating the syringe to discharge residual air remaining in the liquid medicine container, wherein a first check valve located on a liquid medicine container side of a connection portion to the connection flow conduit in the ventilation flow conduit regulates a flow of air and the liquid medicine from the liquid medicine container to the connection flow conduit and the syringe in the ventilation flow conduit, and a second check valve located in the connection flow conduit regulates a flow of the air from the ventilation flow conduit to the liquid delivery flow conduit in the connection flow conduit.

* * * * *